United States Patent [19]

Delaney

[11] Patent Number: 4,655,531

[45] Date of Patent: Apr. 7, 1987

[54] ELECTRICAL COUPLER

[76] Inventor: Edward J. Delaney, 119 Aycrigg Ave., Passaic Park, N.J. 07055

[21] Appl. No.: 778,439

[22] Filed: Sep. 20, 1985

Related U.S. Application Data

[63] Continuation-in-part of Ser. No. 515,774, Jul. 21, 1983, abandoned.

[51] Int. Cl.[4] ..... H01R 13/73

[52] U.S. Cl. ..... 339/135; 339/197 R

[58] Field of Search ..... 339/135, 197 R, 197 B

[56] References Cited

U.S. PATENT DOCUMENTS

| | | | |
|---|---|---|---|
| 1,666,411 | 4/1928 | D'Olier, Jr. | 339/135 |
| 1,683,904 | 9/1928 | Knoblock | 339/135 |
| 1,717,877 | 6/1929 | D'Olier, Jr. | 339/135 |
| 1,908,587 | 5/1933 | D'Olier, Jr. | 339/135 |
| 1,914,993 | 6/1933 | D'Olier, Jr. | 339/135 |
| 1,925,716 | 9/1933 | D'Olier, Jr. | 339/135 |

*Primary Examiner*—John McQuads

*Attorney, Agent, or Firm*—Melvin K. Silverman; Joseph A. Giampapa

[57] ABSTRACT

An electrical coupler for use with a ceiling-suspended chain lamp having a two-part housing secured together with an internally threaded ring fitted over externally threaded ends of the two parts. The electrical coupler permits ease of removal of the suspended lamp without any requirement to remove the electrical wiring within the ceiling suspended lamp.

6 Claims, 4 Drawing Figures

ELECTRICAL COUPLER

REFERENCE TO RELATED APPLICATION

This application is a continuation-in-part to U.S. Ser. No. 515,774 filed July 21, 1983 now abandoned.

BACKGROUND OF THE INVENTION

1. Field of Invention

The invention relates to an electrical coupler for releasably connecting a hanging lamp by a hanging chain to the ceiling mount of an electrical receptacle, in order to permit a hanging lamp to be quickly and safely connected to or disconnected from the chain mounted to the ceiling without unwiring the lamp from the electrical receptacle.

2. Summary of the Prior Art

The connection and/or disconnection of a hanging lamp—generally known as a chandelier—has historically presented a problem to the unskilled layperson in that the services of an electrician, or at least a "handyman," have been required to accomplish the task.

Prior art couplers and adapters do not reveal any structure that would render sufficiently simple the job of coupling and/or uncoupling a chandelier to the ceiling mount of an electrical receptacle. Accordingly, hanging a chandelier, or removing one in order to clean or repair it, remains beyond the realm of a layperson. Moreover, prior art devices pose potentially fatal safety hazards, as is more fully discussed below.

It is also to be appreciated that new installations of hanging lamps and the like are greatly simplified. Typically, installation is accomplished by a two person team. The first person does the wiring of the lamp to the ceiling based electrical receptacle, while the second person holds and supports the weight of the chandelier. With the present invention, only one person is required for the installation—firstly, the installer wires the first housing of the coupler to the electrical receptacle of the ceiling; secondly, the installer wires the second housing of the coupler to the lamp and, lastly, the installer connects the coupler housings via a socket means.

As best known to Applicant, the prior art encompasses U.S. Pat. No. 1,007,054 to Bazell; U.S. Pat. No. 1,590,512 to Hopkins; U.S. Pat. No. 2,237,956 to Arras; U.S. Pat. No. 3,985,417 to Fenton; and U.S. Pat. Nos. 1,908,587, 1,914,993, 1,717,877 and 1,666,411 to D'Olier, Jr.

The closest reference, U.S. Pat. No. 1,717,877 to D'Olier, warrants particular attention. The U.S. Pat. No. 1,717,877 to D'Olier shows a double interface coupler arrangement requiring separate sockets and plugs at both ends of an extension, which extension additionally serves to hold and support the chandelier. Thus, the structure of the U.S. Pat. No. 1,717,877 requires two plugs and two sockets, one set at each end thereof, while the structure of Applicant's invention exhibits only a single interface and, thereby, only one plug and one socket secured in a single plane by an easily connectible/disconnectible circumferential external threading.

The Applicant's device can be located at the top of the chandelier chain arrangement and, as such, permits any type of chandelier chain to be used in connection therewith. Such is not possible with the electrical coupler of the U.S. Pat. No. 1,717,877 because that arrangement requires the entire length of the chandelier cord or chain for its operation with, as above noted, a separate socket arrangement at both the top and bottom thereof.

Moreover, with the coupler of the U.S. Pat. No. 1,717,877 it is not possible to vary the location of the couplers, whereas the present inventive electrical coupler is adapted for insertion at any intermediate point along the entire length of the hanging chain associated with the hanging lamp. In other words, the U.S. Pat. No. 1,717,877 defines a permanent connection between the ceiling receptacle and the top of the lamp; while with the instant invention, the claimed structure is a permanent part only of the hanging chain, not of the hanging lamp or the ceiling receptacle.

Finally, the electrical connector of D'Olier's U.S. Pat. No. 1,717,877 presents certain safety problems. The structure of the U.S. Pat. No. 1,717,877 electrical connector presents a safety concern in that, in the event that insulation were to become abraded-off the current-carrying wires thereof, the entire chandelier chain would become electrified and impose a serious hazard. In Applicant's design, the electrical wiring is completely covered by the non-conductive first and second housings. Therefore, the likelihood of damage to the interior wires is remote and, were such damage to occur, no safety problem would exist because of the insulative housings.

A further safety hazard in the design of the U.S. Pat. No. 1,717,877 lies in the ceiling interface. More particularly, if the upper (ceiling) interface of the U.S. Pat. No. 1,717,877 design is not removed first, the result will be a "live" outlet at the bottom, swinging freely at a level within the reach of an unknowing adult or child. In Applicant's design, the chandelier coupler can be suspended at ceiling level and thereby kept within three inches of the ceiling surface. Accordingly, it is impossible for a "hot" wire to be touched by a household member.

As a result of the above-described differences in structure between D'Olier's U.S. Pat. No. 1,717,877 and the instant invention, the following functional advantages are achieved:

1. The length of the hanging chain can be easily shortened during installation, removal and re-installation of the chandelier. Since the U.S. Pat. No. 1,717,877 structure can only be used with the entire length of the hanging chain utilized, the electrical connector of the U.S. Pat. No. 1,717,877 is of highly limited practical value.

2. More than simply eliminating one of the plugs of the U.S. Pat. No. 1,717,877 structure, the present invention changes the location of the plug to yield a safer electrical environment when installing, removing or cleaning the chandelier. As above noted, the U.S. Pat. No. 1,717,877 structure potentially permits a "live" outlet to hang at a height where unknowing adults or children might touch it; whereas with the structure of the instant invention, coupling or uncoupling can be accomplished at a height high enough to make it difficult to be unintentionally touched, particularly by children; and 3. The requirement for the direct connection of the lamp to the end of the hanging chain, as is the case in the U.S. Pat. No. 1,717,877, increases the possibility of physical damage to the lamp during the disconnect operation at which time many forces, stresses and impacts are invariably involved in separating a plug of the type shown in FIGS. 5 and 6 of the U.S. Pat. No. 1,717,877. Such problem is also eliminated with Applicant's structure.

Hence, none of the above-cited art, nor any other known to Applicant, provides and electrical coupler for releasably connecting and/or disconnecting a hanging lamp by a hanging chain to the ceiling mount of an electrical receptacle that would render the same usable by a layperson having little or no knowledge of electrical wiring or circuitry.

SUMMARY OF THE INVENTION

The invention relates to an electrical coupler for releasably connecting a hanging lamp by a hanging chain to a ceiling mount of an electrical receptacle. The coupler includes a first housing having an uninterruptible electro-mechanical connection to a suitable intermediate point of the hanging chain, thereby defining upper and lower segments of the chain. The first housing exhibits an upper end which faces the ceiling mount and a lower end which is disposed oppositely therefrom, the lower end defining an open face of the first housing. Also included in the coupler is an electrical socket means which is secured within the open face lower end of the first housing, this socket having electrical communication to said first housing. There is provided a second housing having an upper end and a lower end, the lower end defining an open face of the second housing, and the lower end disposed oppositely from the upper end thereof. The open face of said second housing comprises a structure complementary to and, engagable with, said open face of said first housing. There is also provided an electrical plug which is press-fittable into said electrical socket of said first housing, this plug being set within the open upper end of the second housing. There is further provided an electro-mechanical extension means extending axially downward from the plug to the lower end of the second housing to an exit area in the lower end of the second housing, the exit area defining an electro-mechanical interface to the lower segment of the hanging chain, to the other end of the lower segment permanently attached to the hanging lamp. Finally, there is provided securement means for holding the first and second housings together after the electrical socket and plug have been connected. Therein, the second housing and its associated plug extension means constitute a permanent part of the hanging chain which permanent part permits a convenient, releasable coupling and uncoupling of the lower segment of the hanging chain to and from the first housing and its associated electrical socket.

Accordingly, it is an object of the present invention to provide a coupling by which an overhead hanging lamp or chandelier may be easily and quickly connected or disconnected in order to perform such procedures as installation, maintenance and cleaning thereof.

A further object is to provide an electrical coupler for releasably connecting a hanging lamp or chandelier to a ceiling mount of a ceiling-disposed electrical receptacle, that may be readily used by a lay person having no particular knowledge of electrical wiring or circuitry.

The above and yet further objects and advantages of the present invention will become apparent in the hereinafter set forth Detailed Description of the Invention, Drawings, and appended Claims.

DETAILED DESCRIPTION OF THE INVENTION

Figure 1:
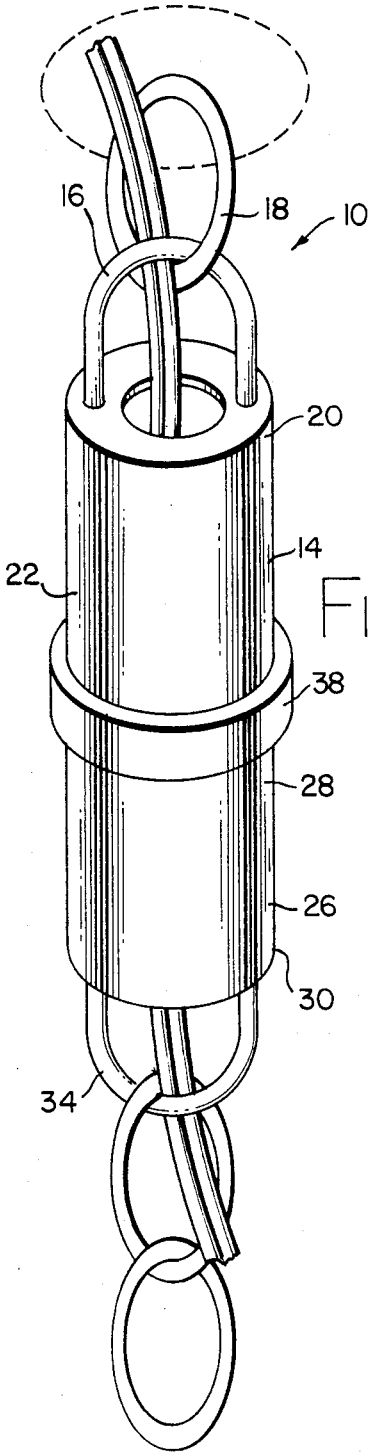
FIG. 1 is a perspective view of the present invention.

With reference to the view of FIG. 1, there is shown an electrical coupler adapted for releasably connecting a hanging lamp (not shown) by a hanging chain 10 to the ceiling mount of an electrical receptacle (not shown).

The various electro-mechanical components of the coupler include a first housing 14 having an uninterruptible electrical connection 16 and mechanical connection 18 to the ceiling mount. First housing 14 exhibits an upper end 20 which faces the ceiling mount, and a lower end 22 disposed oppositely therefrom. Said lower end 22 defines an open face, i.e. an open end of a solid right cylindrical element which is comprised by said first housing.

Still with reference to FIG. 1, there is provided within said first housing an electrical socket means 24 which is secured within said open-faced lower end 22 of said first housing. Said socket means 24 has electrical communication with said uninterruptible electrical connection 16 deriving from the ceiling electrical receptacle (not shown).

Also seen in FIG. 1 is a second housing 26 having an upper end 28 and a lower end 30. The upper end 28 comprises a structure complementary to, and engagable with, said lower end 22 of the first housing 14.

An electrical plug 32, which is press-fitable into the socket means 24 of the first housing 14, is provided; said plug 32 being set within the open upper end 28 of the second housing 26. There is also provided electrical extension means 33 and mechanical extension means 34 extending axially downward from said plug 32, through said lower end 30 of the second housing 26, to an exit area 36 comprising an electro-mechanical interface to which a hanging lamp may be permanently attached. Thereby, loop element (mechanical interface means) 34 and extension means (electrical interface) 33 co-act to form a permanent connection to a hanging lamp or like device.

Figure 2:
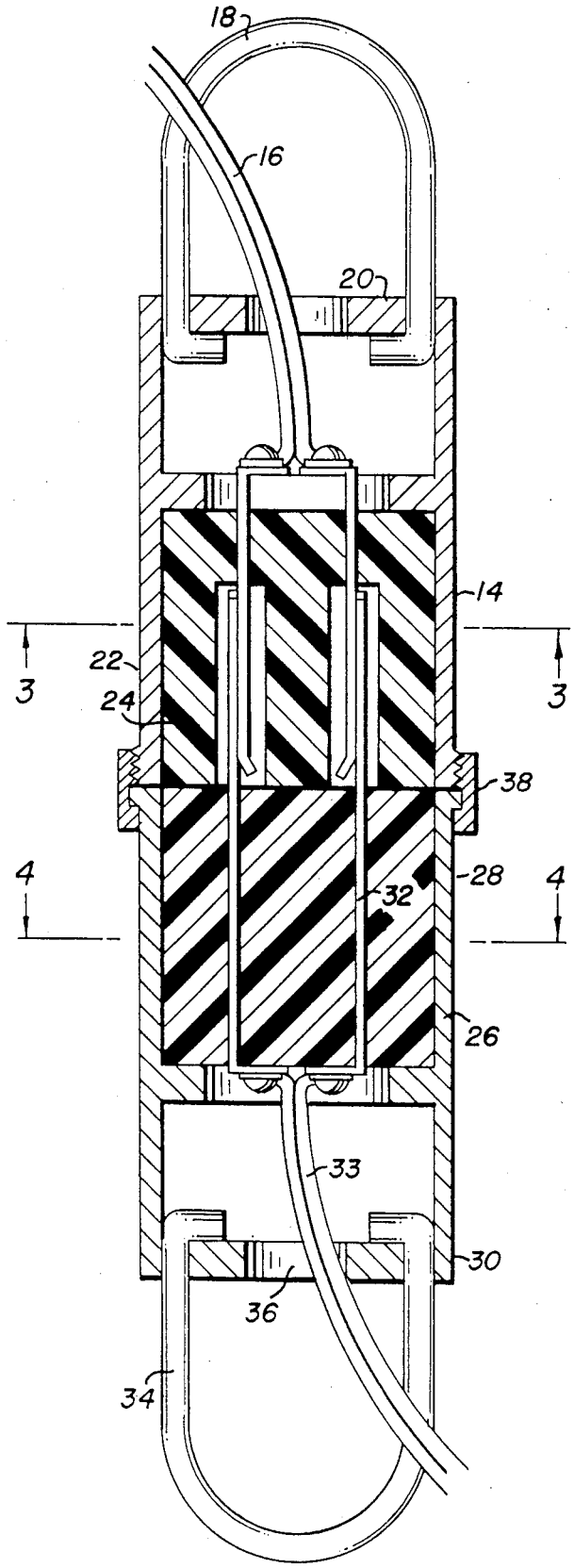
FIG. 2 is a longitudinal cross-sectional view of the present invention.

Securement means 38 is provided for securing together first housing 14 and second housing 26 after socket means 24 and plug 32 have been connected. Further details of securement means 38 can be seen in FIG. 2, wherein a circumferential threaded coupler running fully about the exterior of the lower end 22 of the first housing 14 can be seen.

It is to be appreciated that said second housing 26 and its associated plug 32, together with extension means 33 and loop element 34, constitute a permanent part of the swag lamp or chandelier to be connected/disconnected; and that such permanent part—being easily plugged into or unplugged from the permanent connection between said first housing 14 and the ceiling receptacle—facilitates the installation or removal of the lamp or chandelier.

It is to be further appreciated that the present inventive coupler is also suitable for use in applications where the lamp or other item to be hung is not directly in line with the ceiling receptacle. For example, oftentimes the ceiling receptacle for a room is placed in the center thereof, whereas the resident or apartment dweller wants the actual light source to be in a corner of the room (such as for over a dining table). In this circumstance, normally extra extension wire and support brackets are employed to string the lamp over to the desired location; however, the safety hazards described earlier would still exist. If Applicant's coupler were used in such a situation, the safety hazard can be avoided and the coupler inserted at any intermediate point in the hanging chain that the user desires.

Figure 3:
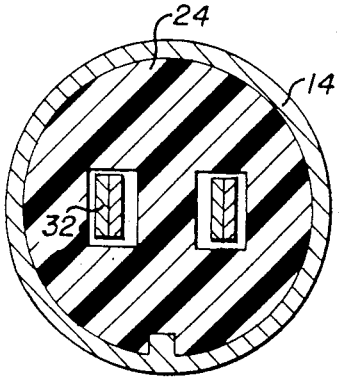
FIG. 3 is a radial cross-sectional view taken along line 3—3 of FIG. 2.
Figure 4:
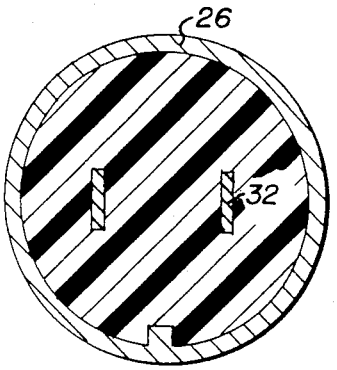
FIG. 4 is a radial cross-sectional view taken along line 4—4 of FIG. 2.

FIGS. 3 and 4 comprise radial cross-sectional views taken through the centers of the upper and lower housings respectively. In FIG. 3 may be seen the housing wall 14, the socket means 24 and the plug 32 which extends the entire length of the second housing 26 and along most of the axial length of the first housing 14. The contact of the upper and lower set of leads is shown in the view of FIG. 3.

Within the purview of this invention, there are aesthetic aspects in addition to those electro-mechanical aspects enumerated above that are to be particularly appreciated. Specifically, the general cylindrical shape of the coupler together with the symmetric loop elements 18 and 34 at the top and bottom respectively of the coupler are to be noted. It is, of course, to be seen that these mechanical elements render more practical the use of the present invention for the intended purpose of providing an electrical coupler that can be readily used by a lay person having no particular knowledge of electrical wiring without, however, compromising the aesthetic integrity of the hanging lamp as such.

Beyond the aesthetic value of the present coupler in association with a lamp, it is to be further appreciated that the combination of said housings 14 and 26, together with the loop elements 18 and 34, may be used to suspend hanging plants or art objects from a ceiling.

While there have been herein shown and described the preferred embodiments of the present invention, it is to be understood that the invention may be embodied otherwise than as herein illustrated and described and that within said embodiments certain changes in the detail and construction, and the form and arrangement of the parts, may be made without departing from the underlying ideas or principles of this invention, within the scope of the appended claims.

I claim:

1. An electrical coupler for releasably connecting a hanging lamp by a hanging chain to a ceiling mount of an electrical receptacle, said coupler comprising:

(a) a first housing having an uninterruptible electrical and mechanical connection to a suitable intermediate point of said hanging chain, said point thusly defining upper and lower segments of said hanging chain, said first housing having an upper end facing the ceiling and a lower end disposed oppositely therefrom, said lower end defining an open face of said first housing;

(b) an electrical socket means secured within said open face of said lower end of said first housing, said socket means axially secured within said first housing, said socket means comprising a substantially integral insulative body;

(c) a second housing having an upper end and a lower end, said upper end defining an open face of said second housing, said lower end disposed oppositely therefrom, said open face of said second housing comprising a structure complementary to, and engagable with, said open face of said first housing;

(d) an electrical plug press-fittable into said electrical socket means of said first housing, said plug set within said open upper end of said second housing, said plug comprising a substantially integral insulative body;

(e) electrical mechanical extension means extending axially downward from said plug through the lower end of said second housing to an exit area within said lower end of said second housing, said exit area comprising an electrical and mechanical interface to the lower segment of said hanging chain, to the other end of said lower segment permanently attached to said hanging lamp; and (f) exterior circumferential securement means for holding said first and second housings together after said electrical socket means and plug are connected, whereby said second housing and its associated plug and extension means constitute a permanent part of said hanging chain which permanent part thereby permits convenient, releasable coupling and decoupling of said lower segment of said hanging chain to said first housing and to its electrical socket means.

2. The electrical coupler as recited in claim 1 in which said securement means comprises a circumferential, threaded, coupler about the exterior of said first and second housings.

3. The electrical coupler as recited in claim 1 in which said first and second housings each define solid right cylindrical elements.

4. The electrical coupler as recited in claim 1 further comprising mechanical connection of said first housing to said ceiling mount comprises a loop structure, and a mechanical interface of said extension means to the hanging lamp comprises a loop structure.

5. The electrical coupler as recited in claim 2 further comprising a mechanical connection of said first housing to said ceiling mount comprises a loop structure, and said mechanical interface of said extension means to the hanging lamp comprises a loop structure.

6. The electrical coupler as recited in claim 3 further comprising a mechanical connection of said first housing to said ceiling mount comprises a loop structure, and a mechanical interface of said extension means to the hanging lamp comprises a loop structure.

* * * * *